US010505251B2

(12) United States Patent
Liao et al.

(10) Patent No.: US 10,505,251 B2
(45) Date of Patent: Dec. 10, 2019

(54) CABLE FOR COUPLING A COAXIAL LINE TO A STRIP-LINE INCLUDING A COUPLING GROUND PLANE FOR REDUCING PASSIVE INTERMODULATION INTERFERENCE IN THE CABLE

(71) Applicant: Huawei Technologies Co., Ltd., Shenzhen, Guangdong (CN)

(72) Inventors: Zhiqiang Liao, Shenzhen (CN); Weihong Xiao, Shenzhen (CN); Qiyi Lu, Shenzhen (CN); Zhuozhen Xu, Makati (PH)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/824,895

(22) Filed: Nov. 28, 2017

(65) Prior Publication Data

US 2018/0083335 A1 Mar. 22, 2018

Related U.S. Application Data

(63) Continuation of application No. PCT/CN2015/080418, filed on May 29, 2015.

(51) Int. Cl.
*H01P 5/08* (2006.01)
*H01R 4/02* (2006.01)
(Continued)

(52) U.S. Cl.
CPC ..... *H01P 5/085* (2013.01); *H01P 3/087* (2013.01); *H01P 3/088* (2013.01); *H01P 5/026* (2013.01);
(Continued)

(58) Field of Classification Search
CPC ..... H01P 5/085
(Continued)

(56) References Cited

U.S. PATENT DOCUMENTS 4,346,355 A * 8/1982 Tsukii ..... H01P 5/085 333/260
5,628,057 A 5/1997 Phillips et al.
(Continued)

FOREIGN PATENT DOCUMENTS

CN 102157767 A 8/2011
CN 102569949 A 7/2012
(Continued)

OTHER PUBLICATIONS

Foreign Communication from a Counterpart Application, Chinese Application No. 201580044364.2, Chinese Office Action dated Jun. 28, 2019, 7 pages.

*Primary Examiner* — Benny T Lee
(74) *Attorney, Agent, or Firm* — Conley Rose, P.C.

(57) ABSTRACT

A cable and a high-frequency device are provided to reduce passive intermodulation interference. The cable includes a strip line and a coaxial line. The strip line includes (in an outer-to-inner sequence) a strip-line outer conductor, a strip-line signal cavity, and a strip-line inner conductor. The coaxial line includes (in an outer to inner sequence) a coaxial-line outer conductor, a first insulation medium, and a coaxial-line inner conductor. The cable further includes a coupling ground plane provided with a coupling aperture portion. The coaxial line is disposed in the coupling aperture portion, the coaxial-line outer conductor is coupled to the coupling ground plane, the strip-line outer conductor is connected to the coupling ground plane, and the strip-line inner conductor is connected to the coaxial-line inner conductor.

7 Claims, 5 Drawing Sheets

(51) Int. Cl.

| | |
|---|---|
| ***H01R 4/06*** | (2006.01) |
| ***H01P 5/02*** | (2006.01) |
| ***H01R 9/05*** | (2006.01) |
| ***H01P 3/08*** | (2006.01) |

(52) U.S. Cl.
CPC ..... *H01P 5/028* (2013.01); *H01R 4/02* (2013.01); *H01R 4/06* (2013.01); *H01R 9/05* (2013.01)

(58) Field of Classification Search
USPC ..... 333/33, 260
See application file for complete search history.

(56) References Cited

U.S. PATENT DOCUMENTS 5,823,791 A * 10/1998 Bellantoni et al. ..... H01P 5/085 439/63
6,236,287 B1 * 5/2001 Quan et al. ..... H01P 5/085 333/260
6,366,185 B1 * 4/2002 Keesey et al. ..... H01P 5/085 333/246
7,140,913 B2 11/2006 Heibler et al.
2008/0068278 A1 3/2008 Noro
2012/0244727 A1 9/2012 Harel et al.
2013/0342280 A1 12/2013 Blanton et al.
2016/0372809 A1 12/2016 Liu et al.
2017/0288306 A1 10/2017 Sledkov et al.

FOREIGN PATENT DOCUMENTS

CN 202797223 U 3/2013
CN 103414010 A 11/2013
CN 104037475 A 9/2014
CN 203826529 U 9/2014
CN 104466405 A 3/2015
GB 2308511 A 6/1997
JP H07240245 A 9/1995

* cited by examiner

CABLE FOR COUPLING A COAXIAL LINE TO A STRIP-LINE INCLUDING A COUPLING GROUND PLANE FOR REDUCING PASSIVE INTERMODULATION INTERFERENCE IN THE CABLE

CROSS-REFERENCE TO RELATED APPLICATIONS

This application is a continuation of International Application No. PCT/CN2015/080418, filed on May 29, 2015, the disclosure of which is hereby incorporated by reference in its entirety.

TECHNICAL FIELD

The present application relates to the communications field, and in particular, to a cable and a high-frequency device using the same.

BACKGROUND

In an existing process for designing a base station antenna, cables for signal transmission in the base station antenna are all formed based on combination of and interconnection among a strip line, a microstrip, and a coaxial line. A basic composition of the strip line includes, in an outer-to-inner sequence, a strip-line outer conductor (a strip-line ground plane), a strip-line signal cavity, and a strip-line inner conductor. A basic composition of the coaxial line includes, in an outer-to-inner sequence, a coaxial-line outer conductor (a coaxial-line ground plane), an insulation medium, and a coaxial-line inner conductor.

Currently, the strip line is connected to the coaxial line by means of welding or by using a screw. Specifically, in one manner of connecting the strip line and the coaxial line, the coaxial-line outer conductor is first welded to a ground block, and the ground block is connected to the strip-line outer conductor by using a screw. In another manner of connecting the strip line and the coaxial line, the coaxial-line outer conductor is directly welded to the strip-line outer conductor.

In the foregoing two manners of connecting the strip line and the coaxial line, the coaxial line is connected to the strip-line outer conductor by means of welding or by using a screw. Because metal contact and welding are both reasons for generating passive intermodulation interference, when the base station antenna operates in an existing manner of connecting the strip line and the coaxial line, quite a lot of passive intermodulation interference is easily generated. Consequently, communication quality of a communications system is affected. Passive intermodulation refers to an intermodulation effect caused by non-linearity of a passive component when the component operates in a case of multiple high-power carrier frequency signals.

SUMMARY OF THE INVENTION

Embodiments of the present application provide a cable and a high-frequency device using the same, so that passive intermodulation interference generated in the cable can be reduced, and communication quality of a communications system can be improved.

To achieve the foregoing objective, the following technical solutions are used in the embodiments of the present application:

According to a first aspect, an embodiment of the present application provides a cable, including a strip line and a coaxial line, where the strip line includes, in an outer-to-inner sequence, a strip-line outer conductor, a strip-line signal cavity, and a strip-line inner conductor, and the coaxial line includes, in an outer-to-inner sequence, a coaxial-line outer conductor, a first insulation medium, and a coaxial-line inner conductor; and the cable further includes a coupling ground plane, where a coupling aperture portion penetrating the coupling ground plane is disposed in the coupling ground plane, the coaxial line is disposed in the coupling aperture portion, the coaxial-line outer conductor is coupled to the coupling ground plane, the strip-line outer conductor is connected to the coupling ground plane, and the strip-line inner conductor is connected to the coaxial-line inner conductor.

With reference to the first aspect, in a first possible implementation of the first aspect, the cable further includes a second insulation medium, and the second insulation medium is disposed between the coaxial-line outer conductor and the coupling ground plane.

With reference to the first aspect, or the first possible implementation of the first aspect, in a second possible implementation of the first aspect, the strip-line outer conductor and the coupling ground plane are an integral metal piece.

With reference to the first aspect, or the first possible implementation of the first aspect, or the second possible implementation of the first aspect, in a third possible implementation of the first aspect, the coaxial-line outer conductor is a cylinder, and the coupling aperture portion is a cylindrical aperture portion.

With reference to any one of the first aspect, or the first possible implementation of the first aspect to the third possible implementation of the first aspect, in a fourth possible implementation of the first aspect, the coupling aperture portion penetrates the coupling ground plane.

With reference to any one of the first aspect, or the first possible implementation of the first aspect to the fourth possible implementation of the first aspect, in a fifth possible implementation of the first aspect, the strip-line signal cavity and the coupling ground plane are arranged in parallel.

With reference to any one of the first aspect, or the first possible implementation of the first aspect to the fourth possible implementation of the first aspect, in a sixth possible implementation of the first aspect, the strip-line signal cavity and the coupling ground plane form an included angle.

With reference to any one of the first aspect, or the first possible implementation of the first aspect to the sixth possible implementation of the first aspect, in a seventh possible implementation of the first aspect, the strip-line inner conductor is coupled to the coaxial-line inner conductor.

According to a second aspect, an embodiment of the present application provides a high-frequency device, including the cable according to the first aspect or any implementation of the first aspect.

Embodiments of the present application provide a cable and a high-frequency device using the same. The cable includes a strip line and a coaxial line. The strip line includes, in an outer-to-inner sequence, a strip-line outer conductor, a strip-line signal cavity, and a strip-line inner conductor. The coaxial line includes, in an outer-to-inner sequence, a coaxial-line outer conductor, a first insulation medium, and a coaxial-line inner conductor. The cable further includes a coupling ground plane in which a coupling aperture portion is disposed. The coaxial line is disposed in the coupling aperture portion, the coaxial-line outer conductor is coupled to the coupling ground plane, the strip-line outer conductor is connected to the coupling ground plane, and the strip-line inner conductor is connected to the coaxial-line inner conductor. In comparison with the prior art, passive intermodulation interference caused by welding connection or screw connection between the coaxial-line outer conductor and the strip-line outer conductor is reduced, and communication quality of a communications system is improved.

BRIEF DESCRIPTION OF THE DRAWINGS

To describe the technical solutions in the embodiments of the present application or in the prior art more clearly, the following briefly describes the accompanying drawings required for describing the embodiments. Apparently, the accompanying drawings in the following description show merely some embodiments of the present application, and a person of ordinary skill in the art may still derive other drawings from these accompanying drawings without creative efforts.

DETAILED DESCRIPTION OF THE EMBODIMENTS

The following clearly describes the technical solutions in the embodiments of the present application with reference to the accompanying drawings in the embodiments of the present application. Apparently, the described embodiments are merely some but not all of the embodiments of the present application. All other embodiments obtained by a person of ordinary skill in the art based on the embodiments of the present application without creative efforts shall fall within the protection scope of the present application.

Figure 1:
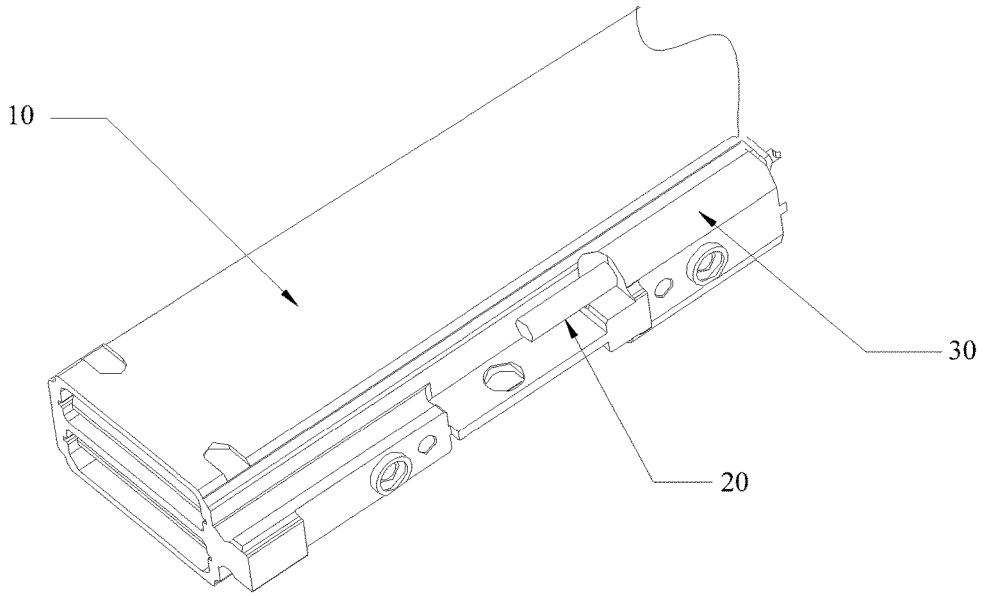
FIG. 1 is a first schematic structural diagram of a cable according to an embodiment of the present application.

An embodiment of the present application provides a cable. As shown in FIG. 1, the cable includes a strip line 10, a coaxial line 20, and a coupling ground plane 30. The coaxial line 20 is disposed in the coupling ground plane 30, a strip-line outer conductor of the strip line 10 is connected to the coupling ground plane 30, and a coaxial-line outer conductor of the coaxial line 20 is also connected to the coupling ground plane 30, so that the strip-line outer conductor and the coaxial-line outer conductor are electrically connected by using the coupling ground plane 30. In addition, the strip-line inner conductor and the coaxial-line inner conductor also are electrically connected in the cable, so that the cable can transmit a signal normally.

Figure 2:
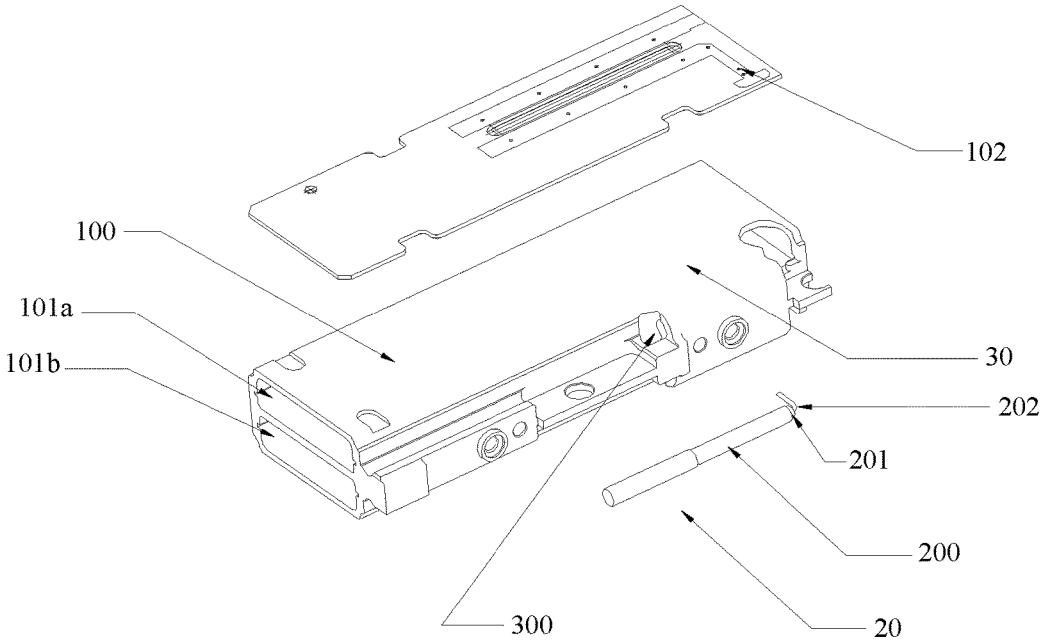
FIG. 2 is an exploded view of the cable according to an embodiment of the present application.

FIG. 2 is an exploded view of the cable provided in FIG. 1 of the present application. The cable includes the strip line, the coaxial line, and the coupling ground plane connecting the strip line and the coaxial line. A composition structure of the strip line is, in an outer-to-inner sequence, a strip-line outer conductor 100, a strip-line signal cavity (the strip-line signal cavity herein includes a signal cavity 101*a* and a signal cavity 101*b*), and a strip-line inner conductor 102. Specifically, the strip-line inner conductor 102 is attached to a strip-line signal line supported printed circuit board (PCB). The PCB is disposed in the strip-line signal cavity and is attached to an inner side of the strip-line outer conductor 100. It should also be noted that if the strip line has multiple strip-line signal cavities, each strip-line signal cavity is provided with a PCB, and a strip-line inner conductor is attached to the PCB. For ease of display, in this embodiment of the present application, the PCB board is separately drawn outside the strip-line signal cavity in FIG. 2. Optionally, the strip-line signal cavity herein may include only one signal cavity. A composition structure of the coaxial line 20 is, in an outer-to-inner sequence, a coaxial-line outer conductor 200, a first insulation medium 201, and a coaxial-line inner conductor 202.

Further, the cable in the exploded view shown in FIG. 2 further includes the coupling ground plane 30, and a coupling aperture portion 300 penetrating the coupling ground plane 30 is disposed in the coupling ground plane 30. In the entire cable provided in this embodiment of the present application, the coaxial line 20 is disposed in the coupling aperture portion 300 of the coupling ground plane 30. Specifically, the coaxial line 20 is horizontally disposed in the coupling aperture portion 300, the coaxial-line outer conductor 200 is coupled to the coupling ground plane 30, and the strip-line outer conductor 100 is connected to the coupling ground plane 30, that is, the coaxial-line outer conductor 200 is electrically connected to the strip-line outer conductor 100 by using the coupling ground plane 30. Specifically, the coaxial line 20 penetrates the coupling ground plane 30, and the coaxial-line inner conductor 202 is also electrically connected to the strip-line inner conductor 102 on the PCB in the strip-line signal cavity 101. In this way, the strip line 10 is electrically connected to the coaxial line 20 entirely, so as to implement signal transmission.

It should be noted that the coupling between the strip external conductor 100 and the coupling ground plane 30 needs to meet a requirement that a high-frequency signal is fully grounded.

Optionally, the connection between the strip-line outer conductor 100 and the coupling ground plane 30 may be various direct metal connections, such as welding connection or connection by using a screw. The connection between the strip-line inner conductor and the coaxial-line inner conductor may also be various direct metal connections, such as welding connection or connection by using a screw.

Preferably, the strip-line outer conductor 100 and the coupling ground plane 30 are an integral metal piece. When the coaxial line 20 is disposed in the coupling aperture portion 300 of the coupling ground plane 30, the strip-line outer conductor 100 may be coupled to the coaxial-line outer conductor 200, so that passive intermodulation interference in the prior art caused by metal contact, welding, or the like between the strip-line outer conductor and the coaxial-line outer conductor when the strip line and the coaxial line are interconnected can be reduced, and further, communications system quality is improved.

Figure 3:
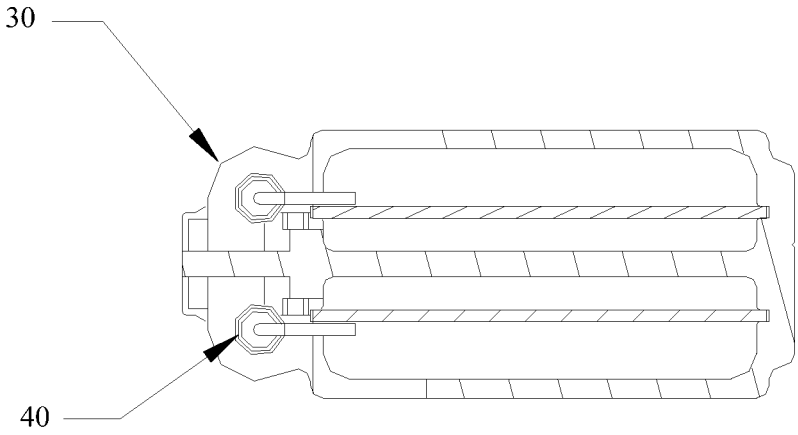
FIG. 3 is a second schematic structural diagram of a cable according to an embodiment of the present application.

Further, as shown in FIG. 3 (FIG. 3 is an expansion diagram of a cross section of the coupling ground plane 30 and the coaxial line disposed in the coupling aperture portion of the coupling ground plane 30 in the cable shown in FIG. 1 in this embodiment of the present application). The cable provided in this embodiment of the present application further includes a second insulation medium 40. The second insulation medium 40 is disposed in the coupling ground plane 30, and is specifically disposed between the coaxial-line outer conductor and the coupling aperture portion. There is an insulation film, that is, the second insulation medium 40, between the coaxial-line outer conductor and the coupling ground plane 30, so that passive intermodulation interference caused by metal contact can be avoided.

Because most coaxial lines 20 (FIGS. 1 and 2) used in an actual process are cylindrical, preferably, the coupling aperture portion 300 (FIG. 2) is a cylindrical aperture portion. In this way, the coaxial-line outer conductor 200 may be coupled to the coupling ground plane 30 in a 360-degree manner, and it is ensured that the coaxial-line outer conductor 200 is relatively well coupled to the coupling ground plane 30 as shown in FIG. 2.

Furthermore, as shown in FIG. 2, the coupling aperture portion 300 penetrates an axis of the coupling ground plane 30, so that when the coaxial line 20 is coupled to the coupling ground plane 30 by using the coupling aperture portion 300, a 360-degree uniform electric field is formed, and a relatively good effect is achieved.

Figure 4:
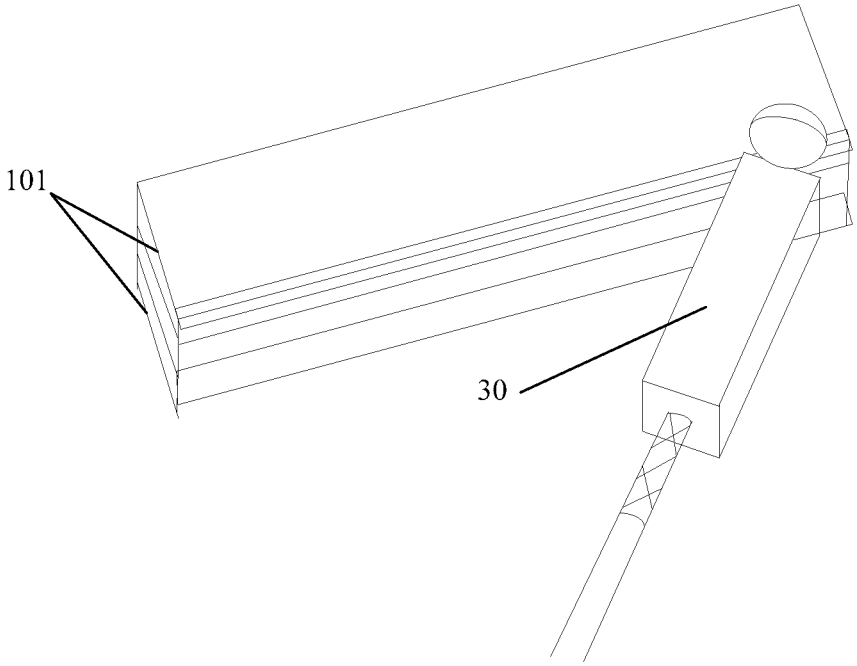
FIG. 4 is a third schematic structural diagram of a cable according to an embodiment of the present application.

It should be noted that the strip-line signal cavity 101 and the coupling ground plane 30 may be arranged in parallel, or may be arranged at an angle (as shown in FIG. 4). When the strip-line signal cavity 101 and the coupling ground plane 30 are arranged in parallel, space in an antenna can be reduced. When the strip-line signal cavity 101 and the coupling ground plane 30 are arranged at an angle, a manufacturing process can be simplified.

Figure 5:
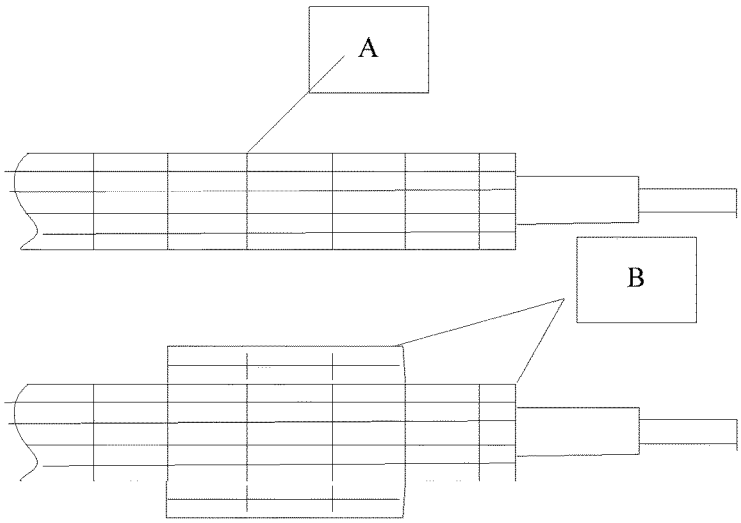
FIG. 5 is a fourth schematic structural diagram of a cable according to an embodiment of the present application.

It should also be noted that the coaxial-line outer conductor in this embodiment of the present application may be a coaxial-line outer conductor of the coaxial line itself, as shown in A (that is, a shadow region) in FIG. 5, or may be an outer conductor formed by adding a 360-degree metal socket, as shown in B (that is, a shadow region) in FIG. 5. In the coaxial line shown in FIG. 5, the coaxial-line outer conductor includes two parts: the added metal socket and an outer conductor of the coaxial line itself.

The cable provided in this embodiment of the present application includes a strip line and a coaxial line. The coaxial line includes a coaxial-line outer conductor, and the strip line includes a strip-line outer conductor. The cable further includes a coupling ground plane provided with a coupling aperture portion. The coaxial line is disposed in the coupling aperture portion, the coaxial-line outer conductor is coupled to the coupling ground plane, the strip-line outer conductor is connected to the coupling ground plane, and a strip-line inner conductor is connected to a coaxial-line inner conductor, so that passive intermodulation interference caused by welding of the coaxial line to a ground block in the prior art can be reduced, and communication quality of a communications system can be improved.

Figure 6:
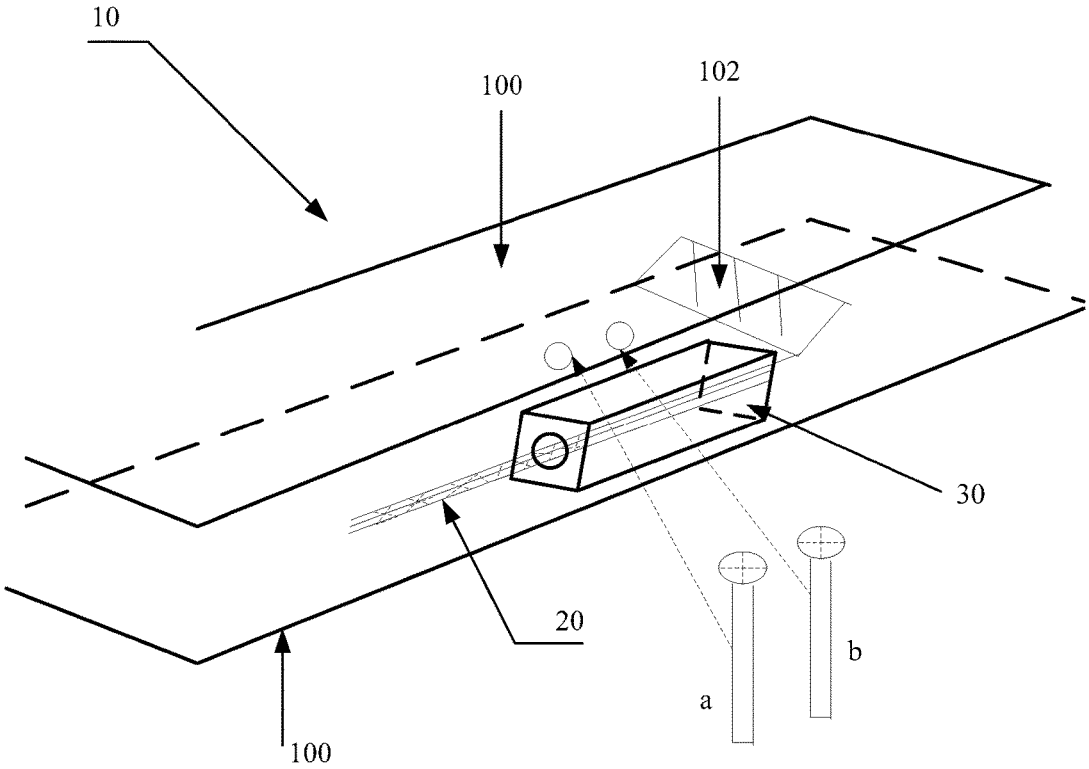
FIG. 6 is a fifth schematic structural diagram of a cable according to an embodiment of the present application.

FIG. 6 is a cable according to another embodiment of the present application. As shown in FIG. 6, the cable includes a strip line 10 and a coaxial line 20. The strip line 10 includes a strip-line outer conductor 100 (divided into an upper ground and a lower ground in this embodiment), and the strip-line signal cavity 101, the strip-line inner conductor 102, the coaxial-line outer conductor 200, the first insulation medium, the coaxial-line inner conductor, the second insulation medium 40, and the coupling ground plane 30 that are shown in FIG. 1 to FIG. 4.

The coupling ground plane 30 is coupled to the coaxial-line outer conductor in an approximately 360-degree manner, the coupling ground plane 30 is connected to a strip line grounding layer (that is, the strip-line outer conductor 100), and the coaxial-line inner conductor is connected to the strip-line inner conductor 102.

In this embodiment, for description of a semi-closed strip line design, the coupling ground plane 30 and the strip-line outer conductor 100 exist independently, and then the upper and the lower grounding layers (that is, the strip-line outer conductor 100) of the strip line are connected to the coupling ground plane 30 by using screws (as shown in a and b in FIG. 6).

Specifically, the coupling ground plane 30 and the strip line 10 are physically designed separately, and the coupling ground plane 30 and the strip line 10 are connected by using a screw, so as to partially reduce passive intermodulation interference. In comparison with the prior art, by means of the present application, welding of the coaxial-line outer conductor to a ground block is omitted. There is an insulation medium between the coaxial-line outer conductor and the coupling ground plane 30, so that a source (that is, direct metal contact) of passive intermodulation interference may be avoided in the design.

The cable provided in this embodiment of the present application includes the strip line and the coaxial line. The coaxial line includes the coaxial-line outer conductor, and the strip line includes the strip-line outer conductor. The cable further includes the coupling ground plane provided with the coupling aperture portion. The coaxial line is disposed in the coupling aperture portion, the coaxial-line outer conductor is coupled to the coupling ground plane, the strip-line outer conductor is connected to the coupling ground plane, and the strip-line inner conductor is connected to the coaxial-line inner conductor, so that passive intermodulation interference caused by welding of the coaxial line to a ground block in the prior art can be reduced, and communication quality of a communications system can be improved.

Figure 7:
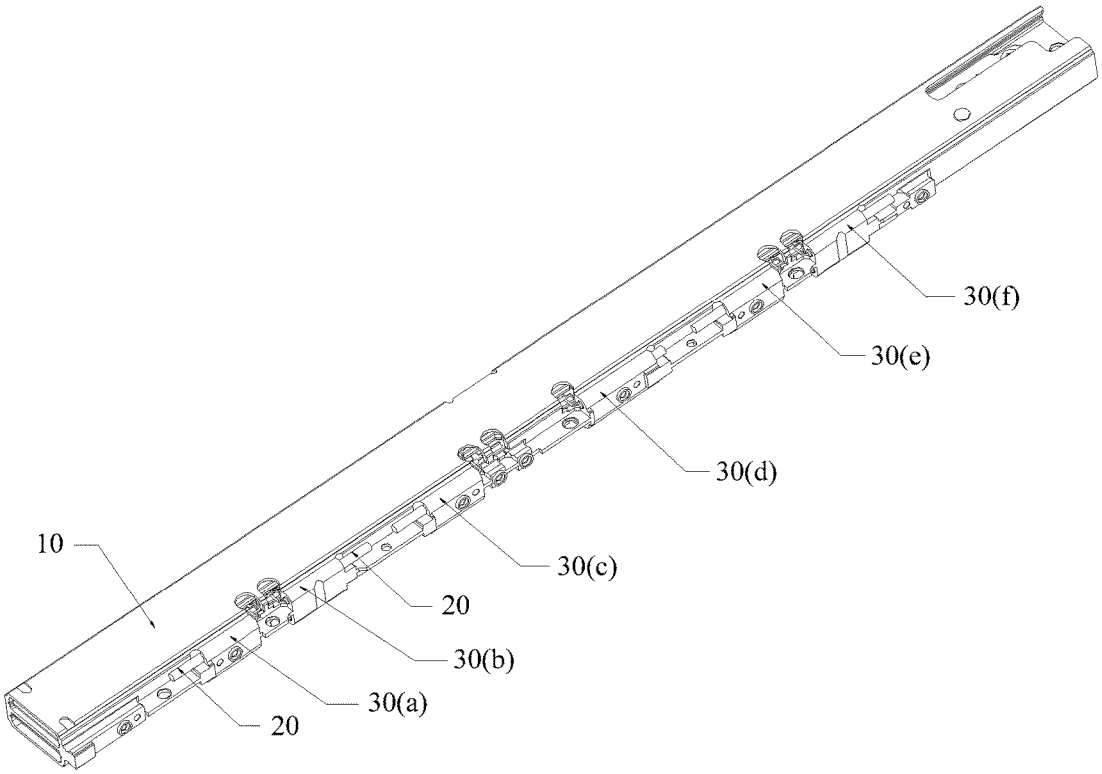
FIG. 7 is a first schematic structural diagram of a phase shifter according to an embodiment of the present application.

An embodiment of the present application provides a phase shifter apparatus. As shown in FIG. 7, the phase shifter apparatus includes the strip line 10, the coaxial line 20, and six coupling ground planes: 30(*a*), 30(*b*), 30(*c*), 30(*d*), 30(*e*), and 30(*f*). Each of the six coupling ground planes are coupled to the coaxial-line outer conductor in an approximately 360-degree manner, each of the six coupling ground planes is connected to a strip-line grounding layer, and the coaxial-line inner conductor is connected to the strip-line inner conductor.

In this embodiment of the present application, to reduce complexity of an actual process design, the coupling ground plane and the strip-line outer conductor are integrated, that is, the coupling ground plane and the strip-line outer conductor are one metal piece, or may be a material that is obtained by electroplating a plastic and that may be used as a metal piece for a high-frequency signal. In addition, a strip-line signal cavity and a coupling aperture portion are integrated.

Usually, the phase shifter apparatus provided in this embodiment of the present application is applied to a base station antenna system. A base station antenna is usually in a dual-polarized design, each polarization requires a phase shifter, and phase shifters of the base station antenna appear in pairs. Therefore, in this embodiment, strip lines used by the phase shifter apparatus are arranged in an up and down manner, and share one grounding layer, so as to reduce space occupied by the two phase shifters. In addition, the coupling aperture portion and the strip-line signal cavity are arranged in parallel, so as to further reduce a size of a phase shifter.

An inner design of the phase shifter may be in two manners: First, a phase is changed by moving medium; second, a phase is changed by changing a physical length of a circuit. In this embodiment, the second manner is used, that is, a physical length relative to a fixed PCB is changed by pulling and sliding a PCB, to implement a phase shift. A principle of the phase shifter is not described in detail herein.

The phase shifter provided in this embodiment of the present application is a one-input-five-output lumped phase shifter (as shown in FIG. 7). The phase shifter includes six coaxial lines. The six coaxial lines are sequentially disposed in six coupling ground planes: 30(*a*), 30 (*b*), 30(*c*), 30(*d*), 30(*e*), and 30(*f*). The six coaxial lines may be connected to the strip line 10 in any manner shown in FIG. 1 to FIG. 6. A signal is coupled and input by using the coaxial line disposed in the coupling ground plane 30(*d*), and then is coupled and output by using the coaxial lines disposed in the coupling ground planes 30(*a*), 30(*b*), 30(*c*), 30(*e*), and 30(*f*).

Figure 8:
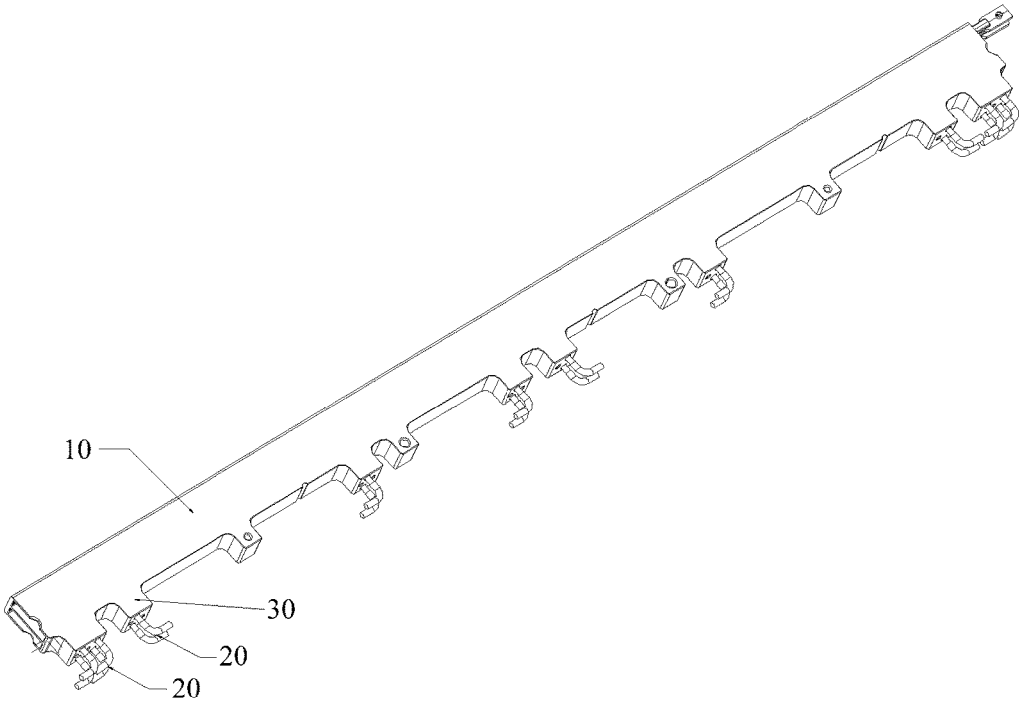
FIG. 8 is a second schematic structural diagram of a phase shifter according to an embodiment of the present application.

FIG. 8 shows another phase shifter apparatus according to an embodiment of the present application. As shown in FIG. 8, the phase shifter apparatus includes a strip line 10, a coaxial line 20, a second insulation medium, and a coupling ground plane 30. The coupling ground plane 30 is coupled to a coaxial-line outer conductor in an approximately 360-degree manner, a coupling ground plane is connected to a strip-line grounding layer, and a coaxial-line inner conductor is connected to a strip-line inner conductor.

In this embodiment of the present application, to reduce complexity of an actual process design, the coupling ground plane and a strip-line outer conductor are integrated, that is, the coupling ground plane and the strip-line outer conductor are one metal piece, or may be a material that is obtained by electroplating a plastic and that may be used as a metal piece for a high-frequency signal. In addition, a strip-line signal cavity and a coupling aperture portion are integrated.

In this embodiment, the strip lines used by the phase shifter apparatus are arranged in an up and down manner, and share one grounding layer, so as to reduce space occupied by the two phase shifters. In addition, the coupling aperture portion is perpendicular to the strip-line signal cavity (that is, a 90-degree angle is formed), so that complexity of assembling the strip line and the coaxial line can be reduced, and the strip line and the coaxial line can be assembled conveniently.

As can be seen from FIG. 8, the phase shifter apparatus provided in this embodiment of the present application is a one-input-nine-output phase shifter.

The phase shifter includes a PCB circuit board and a medium capable of sliding along a direction. The medium slides along an indicated movement direction, an electrical length between an input port and each output port is adjusted, and output ports are connected to a radiating element of an array antenna by using the coaxial line, so that a high-frequency signal at the input port is coupled to the coaxial line by using the strip line, and then forms an electromagnetic wave in the radiating element to radiate out, so as to perform space radio transmission.

For the phase shifter provided in this embodiment of the present application, the coupling aperture portion and the strip-line signal cavity of the phase shifter are not arranged in parallel, but arranged at an angle. Specifically, the coupling aperture portion and the strip-line signal cavity form a 90-degree angle. In this way, the phase shifter may be simply assembled.

The phase shifter provided in this embodiment of the present application uses any cable described in the foregoing embodiments. In comparison with an existing phase shifter, by means of the present application, passive intermodulation interference caused by welding connection or screw connection between a coaxial-line outer conductor and a strip-line outer conductor is reduced, and communication quality of a communications system is improved.

It should be noted that the cable provided in this embodiment of the present application not only may be applied to a phase shifter apparatus, but also may be applied to another high-frequency device such as a filter. This is not limited in the present application.

The foregoing descriptions are merely specific implementations of the present application, but are not intended to limit the protection scope of the present application. Any variation or replacement readily figured out by a person skilled in the art within the technical scope disclosed in the present application shall fall within the protection scope of the present application. Therefore, the protection scope of the present application shall be subject to the protection scope of the claims.

What is claimed is:

1. A cable, comprising:

a strip line comprising, in an outer-to-inner sequence,
- a strip-line outer conductor,
- a strip-line signal cavity, and
- a strip-line inner conductor disposed within the strip-line signal cavity;

a coaxial line comprising, in an outer-to-inner sequence,
- a coaxial-line outer conductor,
- a first insulation medium, and
- a coaxial-line inner conductor; and a coupling ground plane having a coupling aperture portion penetrating the coupling ground plane and disposed in the coupling ground plane, the strip-line signal cavity and the coupling ground plane are arranged in parallel, and wherein the coaxial line is disposed in the coupling aperture portion, the coaxial-line outer conductor is coupled to the coupling ground plane, and the strip-line outer conductor is connected to the coupling ground plane, the strip-line outer conductor and the coaxial-line outer conductor are electrically connected by using the coupling ground plane so as to reduce passive intermodulation interference in the cable.

2. The cable according to claim 1, further comprising:

a second insulation medium disposed between the coaxial-line outer conductor and the coupling ground plane.

3. The cable according to claim 1, wherein the strip-line outer conductor and the coupling ground plane are an integral metal piece.

4. The cable according to claim 1, wherein:

the coaxial-line outer conductor is a cylinder; and the coupling aperture portion is a cylindrical aperture portion.

5. The cable according to claim 1, wherein the strip-line signal cavity and the coupling ground plane form an angle.

6. The cable according to claim 1, wherein the strip-line inner conductor is coupled to the coaxial-line inner conductor.

7. A high-frequency device, comprising:

a cable comprising, a strip line comprising, in an outer-to-inner sequence, a strip-line outer conductor, a strip-line signal cavity, and a strip-line inner conductor disposed within the strip-line signal cavity, and a coaxial line comprising, in an outer-to-inner sequence, a coaxial-line outer conductor, a first insulation medium, and a coaxial-line inner conductor connected to the strip-line inner conductor; and a coupling ground plane having a coupling aperture portion penetrating the coupling ground plane and disposed in the coupling ground plane, the strip-line signal cavity and the coupling ground plane are arranged in parallel, and wherein the coaxial line is disposed in the coupling aperture portion, the coaxial-line outer conductor is coupled to the coupling ground plane, and the strip-line outer conductor is connected to the coupling ground plane, the strip-line outer conductor and the coaxial-line outer conductor are electrically connected by using the coupling ground plane so as to reduce passive intermodulation interference in the cable.

* * * * *